US006899608B2

(12) United States Patent
Huang

(10) Patent No.: US 6,899,608 B2
(45) Date of Patent: May 31, 2005

(54) CLIP MECHANISM ON A GRINDING CLOTH PLATFORM

(76) Inventor: Chin-Chen Huang, No. 12, Industry 41 Rd., Situn District, Taichung City 407 (TW)

( * ) Notice: Subject to any disclaimer, the term of this patent is extended or adjusted under 35 U.S.C. 154(b) by 0 days.

(21) Appl. No.: 10/657,115

(22) Filed: Sep. 9, 2003

(65) Prior Publication Data

US 2005/0054278 A1 Mar. 10, 2005

(51) Int. Cl.[7] ..... B24B 23/00
(52) U.S. Cl. ..... 451/356; 451/364; 451/365; 451/523; 451/524; 451/525
(58) Field of Search ..... 451/356, 364, 451/365, 523, 524, 525

(56) References Cited

U.S. PATENT DOCUMENTS 3,527,111 A * 9/1970 Zimmerman ..... 74/110
3,788,011 A * 1/1974 Hutchins ..... 451/344
3,854,897 A * 12/1974 Attinger ..... 451/356
6,719,620 B1 * 4/2004 Panfili et al. ..... 451/557

* cited by examiner

*Primary Examiner*—Joseph J. Hail, III
*Assistant Examiner*—Shantese McDonald
(74) *Attorney, Agent, or Firm*—Rabin & Berdo, P.C.

(57) ABSTRACT

This invention relates to an improvement of a clip mechanism on a grinding cloth platform wherein the clip mechanism includes a jack post, a movable knob, and a clamp, providing for a bottom side of the movable knob to engage the clamp at the two sides of the jack post, thereby providing a precise clamp force to the clamp. The clamp is put on a non-circular driving portion of the jack post so as to disallow the clamp to turn around the non-circular shaft and to make it move stably downward, thereby making clamping teeth provided at the bottom side of the clamp precisely align with the table board to clamp the grinding cloth to the grinding cloth platform for smooth and stable grinding when a surface of an object is ground on the platform.

6 Claims, 3 Drawing Sheets

CLIP MECHANISM ON A GRINDING CLOTH PLATFORM

FIELD OF THE INVENTION

This invention relates to an improvement of a clip mechanism on a grinding platform, which is mainly used to improve the grinding cloth so as to be firmly installed in the underside of the grinding cloth platform for smooth grinding move in the process of an object surface ground on the platform.

BACKGROUND OF THE INVENTION

According to whitewash on a wall or painting on a wood furniture, in a general working procedure, soils may be mended on the wall or a priming paint may be painted on the surface of the furniture; the surface is made smooth by way of the cloth grinding, and the surface of the object becomes smooth, bright through whitewash or painting. Regarding the cloth grinding work, it is well known in the art that a grinding cloth platform is designed to provide a worker with an easy solution; as shown in FIG. 4, an outside view of a currently representative grinding cloth platform which is simply structured with a table board 10 with a proper area, in which a vertical protruding handle 11 on the top is provided and a layer of an elastic foam 12 is relevantly well stuck in the underside; a grinding cloth 13 is paved on the surface of the foam layer 12, two ends of which are oppositely folded on the top of the two sides of the table board 10 and may be clipped at a fixed position using a clip mechanism provided on the table board 10. The operator may hold the handle 11 by the palm of a hand to grind the surface of the object using the grinding cloth 13 paved at the underside of the table board 10 for achievement of the smooth mending. In FIGS. 1 and 2, a schematic drawing of the clip mechanism provided in the conventional grinding cloth platform is shown, the clip mechanism comprising a jack post 14 with a big head terminal 141, which protrudes upward from a shaft hole 101 provided on the table board 10, in which a compressed spring 15 and a clamp 16 are arranged on the jack post 14 and the compressed spring 15 may provide the clamp 16 with a strain; a movable stem 17 is pivoted with a bolt 18 at the top of the jack post 14, thereby fixing the clamp 16 to the jack post 14, in which a suppressing bar 162 at a length equal to the clamp 16 is provided and protrudes at a front side of the underside of the clamp 16, relatively, while a rabbet 102 is formed on the table board 10; according to FIGS. 2 and 3, where the movable pivoted stem 17 and the bolt 18 of the jack post stay is a configuration, in which a distance from the top of the movable 17 is smaller than that from the underside. As shown in FIG. 2, when the movable stem 17 axial to the bolt 18 moves leftward, in which the top of the stem 17 is made level on the top of the clamp 16, the clamp 16 is lifted up with the strain from the compressed spring 15 and the suppressing bar 162 at the underside is kept away from the rabbet 102 of the table board 10, which stays in a state when the clip mechanism unlocks a location of a released grinding cloth or a grinding cloth to be assembled; as shown in FIG. 3, when the grinding cloth is oppositely folded and located between the clamp 16 and the table board 10, the movable stem 17 axial to the bolt 18 moves rightward at an angle of 180 and the underside of the stem 17 is made level on the top of the clamp 16, thereby possibly downward moving the clamp 16 based on the jack post 14 so that the suppressing bar 162 enters the rabbet 102 of the table board 10 to clamp the grinding cloth 13 for assembly and location.

From the above-mentioned grinding cloth platform of prior art, some problems and defects, when implemented, are found, as shown in the following.

First, the movable stem 17 is kept away from the right side of the jack post 14, so a downward push force provided to the clamp 16, namely a force from the left half side of the clamp 16 occluding the grinding cloth for assembly and fixing, is obviously less than that from the right half side; when a frictional force resulted from the surface of the object ground with the grinding cloth 13 paved at the underside of the grinding cloth platform is produced, the left half side of the grinding cloth 13 is easily made separate from the clamp 16 due to consumption of a clipping capability, thereby potentially causing an unanticipated laceration of the left half side of the grinding cloth.

Second, the clamp 16 protrudes from the front side of the underside and it enters the table board 10 together with the suppressing bar 162 with a length equal to each other to match with the rabbet 102 and to clip the grinding cloth 13 for assembly and fixing; because the distance between the suppressing bar 162 and the rabbet 102 is considerably long, it is more difficult to provide a tight clamping force for suppression, thereby potentially causing a fold so that the grinding cloth cannot completely be made level on the surface of the foam layer 12, which hinders the grinding cloth from smoothly moving and grinding.

Third, the clamp 16 is freely put on the jack post 14 through a post hole, namely the clamp 16 setting on the jack post 144 with a pivot turn capability, so it is difficult for the suppressing bar 162 provided in the underside of the clamp 16 to all the time exactly match with the rabbet 102 arranged on the table board 10, thereby causing a difficult in operation of the clamp 16 downward shifting to clamp the grinding cloth for assembly and fixing.

It is well known from the former explanation that the structured grinding cloth platform may be indeed provided to the operator to easily grind and mend the surface of the object; an exact clamping and assembly of the grinding cloth installed on the platform is corresponding to a smooth shift of the grinding operation on the grinding cloth platform; this invention may provide a solution to said problem.

SUMMARY OF THE INVENTION

The clip mechanism of the conventional grinding cloth platform is difficult to completely provide an firmly installed grinding cloth on the table board, so considering the problem, this inventor being experienced for many years in manufacturing the grinding cloth platform, observing its variations, trying, and improving it finally makes a well structured clip mechanism of the grinding cloth platform as this invention; according to this invention, the jack post is divided into an upper round suppressing head, a shaft linking portion, and a lower hexagonal driving portion, in which said jack post provides a movable knob, through the suppressing head and the shaft linking portion, for the purpose of a definite pivot turn so that a driving force is equally distributed over the clamp to make it stably downward shift, in which during the downward shift of the clamp, the driving portion of the jack post may limit the clamp to vertically smoothly downward shift, making clamp tooth provided in its underside to precisely engage with the table board and securely clamping the grinding cloth to fix it to the grinding cloth platform for smooth grinding operation on the platform.

DETAILED DESCRIPTION OF THE INVENTION

Figure 3:
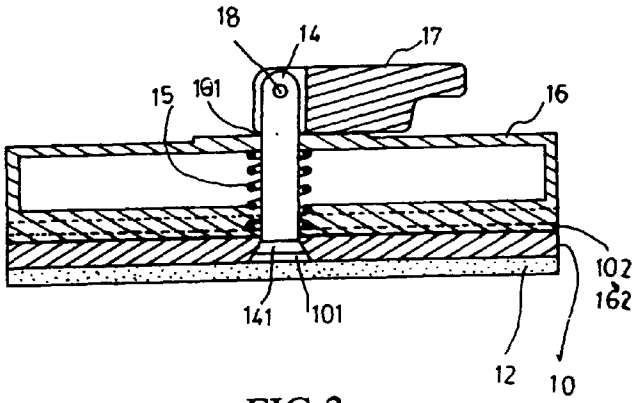
FIG 3 (PRIOR ART)
FIG. 3 shows a schematic drawing of the clip mechanism, at a clamping state, on the grinding cloth platform according to the prior art.
Figure 2:
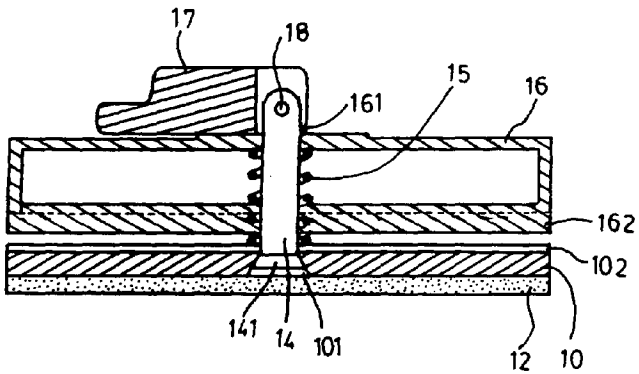
FIG 2 (PRIOR ART)
FIG. 2 shows a 2—2 sectional view of the clip mechanism in FIG. 1 (at a release state).
Figure 1:
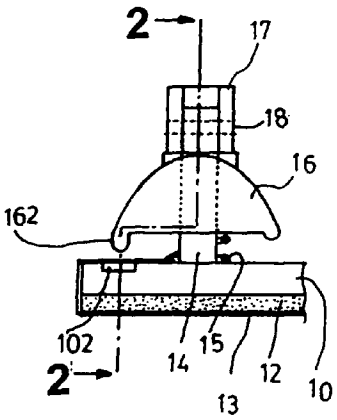
FIG 1 (PRIOR ART)
FIG. 1 shows an outside view of a clip mechanism on a grinding cloth platform according to a prior art.
Figure 4:
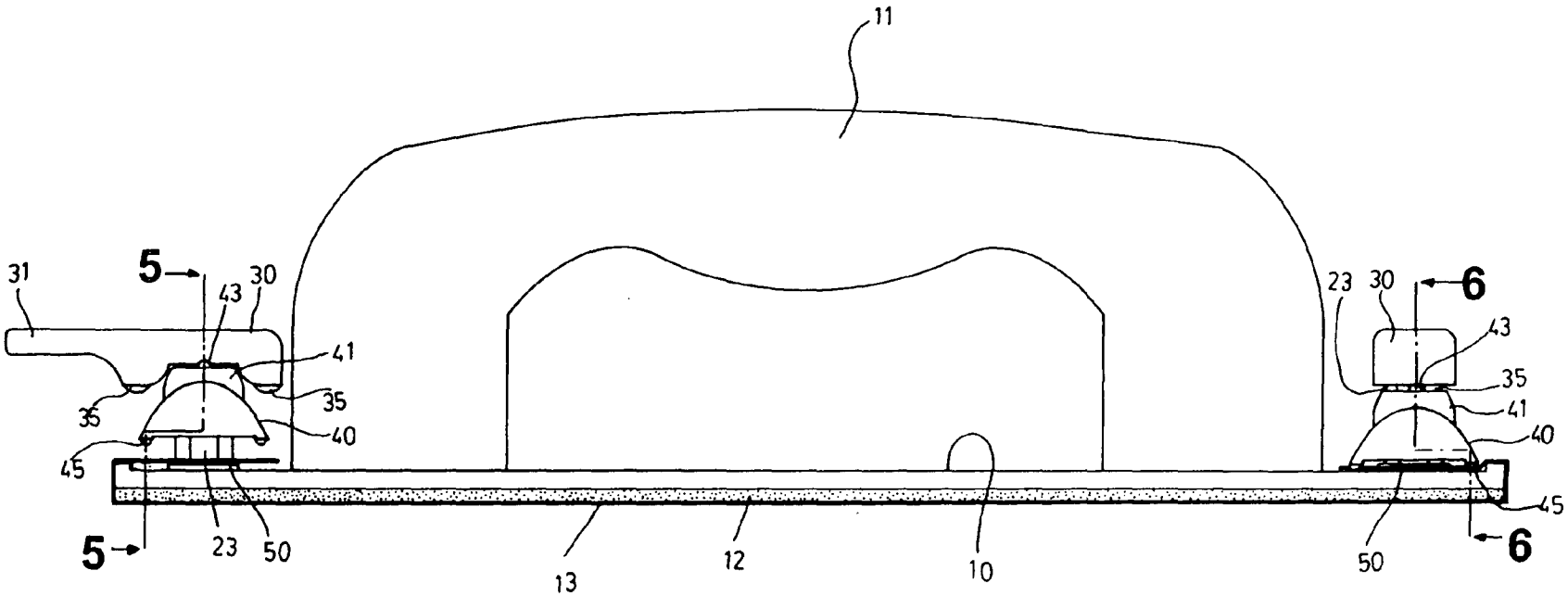
FIG. 4 shows an outside view of the grinding cloth platform according to this invention.

In order to facilitate you to further review and understand the technical description, features, and functions of this invention, a preferable example corresponding to figures and their explanations are taken as follows:

In FIG. 4, an outside view of this invention is provided comprising a basic structure of a grinding cloth platform according to this invention is approximately equal to that in the prior art, such as the table board 10 having a suitable area with a top side provided with a vertical protruding handle 11 for a hand to hold and with a bottom side having an attached elastic foam layer 12, in which a grinding cloth 13 is attached on two sides of a bottom side of the foam layer and oppositely folded on two sides of a top side the table board 10, thereby being fixed through an improved clip mechanism provided on the table board 10, the improved clip mechanism according to this invention comprises a jack post 20, a movable knob 30, and a clamp 40.

The jack post 20 is provided with a suppressing head 21 with a top of a larger circle diameter and with a shaft linking portion 22 of a smaller circle diameter; a non-circular driving portion 23 is provided at the bottom, in which the bottom of the non-circular driving portion 23 is formed with a tapped hole.

The movable knob 30 stretches moves to one side and is provided with a movable stem 31, in which a vertical suppressing slot 32 with a larger circle diameter and a shaft hole 33 with a smaller circle diameter are arranged; at the bottom side around the shaft hole 33, a concave 34 is formed, and the two sides of the concave 34 each comprise a driving cam surface is respectively provided with a driving cam stopping block 35.

For the clamp 40, an engaging cam surface 41 is provided at the top side, a center recess 42 is formed at the center of the engaging cam surface 41, and a located protruding block is formed at the two sides of the center recess 42, in which a centrally located non-circular mounting hole 44 is provided in the center recess 42 and several teeth 45 keeping a predefined distance with each other are provided at the two sides of the underside of the clamp 40.

For the table board, the surface has a combination base 50 formed with a non-circular attachment slot 51.

Through the jack post 20 provided with the top shaft linking portion 22 in the shaft hole 33 of the movable knob 30 and with the suppressing head 21, linking with the movable knob 30, in the suppressing slot 32 of the movable knob 30 and through the jack post provided with the non-circular driving portion 23 inserting the centrally located non-circular mounting hole 44 provided in the center recess 42 of the clamp 40 and covering a suppressing spring 53 at the bottom side within the clamp 40 and with the end of the non-circular driving portion 23, which is inserted into the non-circular attachment slot 51 of the combination base 50 on the table board 10, an improvement of the clip mechanism on the grinding cloth platform is achieved using a locking screw or fastener 54.

Figure 5:
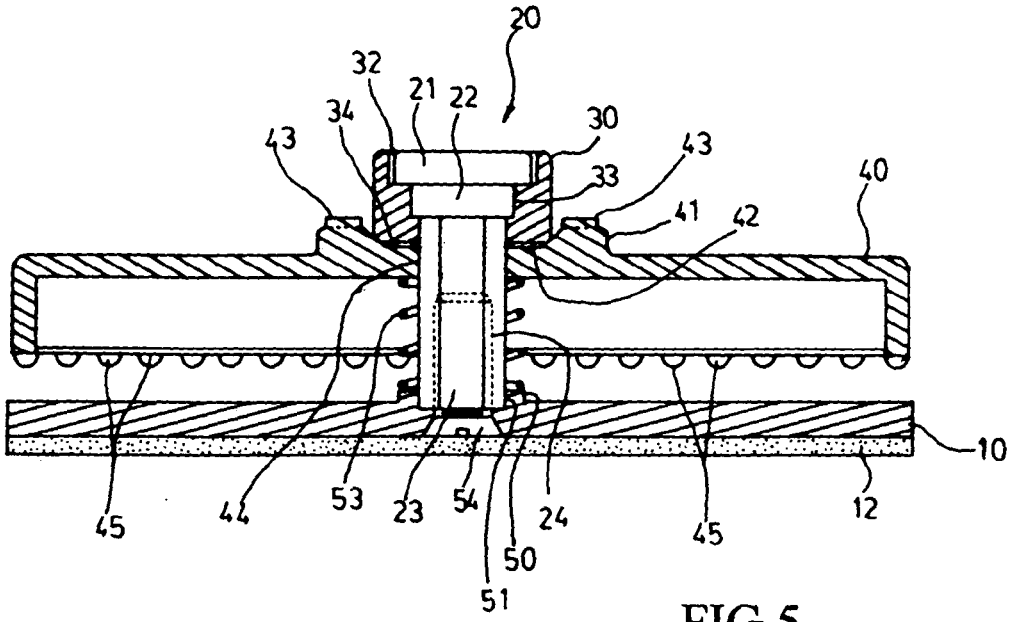
FIG. 5 shows a 5—5 sectional view of the clip mechanism in FIG. 4 (at a release state).

As shown in FIGS. 4 and 5, the movable 30 knob, according to the suppressing head 21 and the shaft linking portion 22 at the top of the jack post 20, is limited in a fixed-point outward knob rotation around the shaft at 90 degrees; the concave 34 at the bottom side of the movable knob 30 may be corresponding to the center recess 42 at the top side of the anti push engaging cam surface 41 of the clamp 40, and then the clamp 40 loses the suppressing force from the movable knob; at this time, the suppressing spring 53 may be located at the underside within the clamp 40, providing a strain to upward lift the clamp 40 so that the clamping tooth 45 at the bottom side of the clamp 40 is impelled to leave from the table board 10, thereby causing a state that the clip mechanism unlock the portion of the released grinding cloth 13 or the grinding cloth 13 to be installed.

Figure 6:
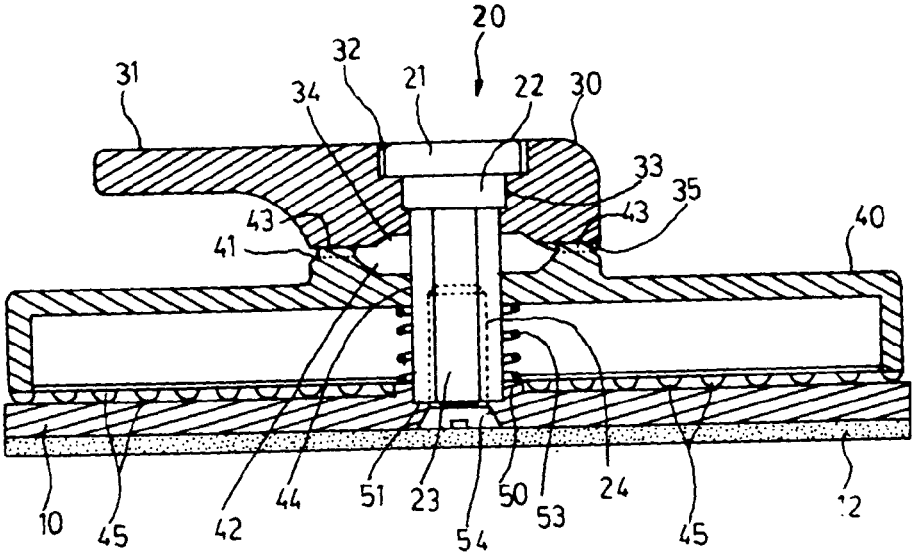
FIG. 6 shows a 6—6 sectional view of the clip mechanism in FIG. 4 (at a clamp state)

As shown in FIGS. 4 and 6, the movable 30 knob, according to the suppressing head 21 and the shaft linking portion 22 at the top of the jack post 20, is limited in a fixed-point outward knob rotation around the shaft at 90 degrees; at this time, the concave 34 at the bottom side of the movable knob 30 may by degrees push forward the center recess 42 at the top side of the engaging cam surface 41 of the clamp 40, thereby possibly downward shifting the clamp 40 until the driving cam stopping block 35 at the two sides of the bottom side of the movable knob 30 touches the located engaging cam stopping block 43 at the two sides of the anti push engaging cam surface 41 of the clamp 40; namely, the movable knob 30 may upward push the clamp to have the clamping tooth 45 at the two sides of the bottom side herein snap the grinding cloth to a fixed position.

From the description above, at least the following practical functions are provided for the improvement of the clip mechanism according to this invention.

First, the bottom side of the movable knob 30 equally lies at the two sides of the jack post 20 of the clamp 40 linking with a pivot to provide a clamping energy to the clamp 40 for precision of a preferable action of the clamp 40.

Second, the centrally located non-circular mounting hole 44 of the clamp 40 is put on the hexagonal non-circular driving portion 23 of the jack post 20, so the jack post 20 may suppress the clamp 40 downward rotating around the shaft for stability, which makes the clamping tooth 45 provided at the bottom side of the clamp 40 precisely fix the grinding cloth to a location for installation.

Third, the grinding cloth may stably fixed between the clamp 40 and the table board 10 on the grinding cloth platform, thereby preventing the grinding cloth from being folded so that an operation of the grinding and shifting on the grinding cloth platform is stable and smooth.

The figures and descriptions disclosed above, however, are the preferable examples of this invention; it is well known that all modification or equivalent changes are made according to the scopes and spirit of this invention; variations or amount of the clamping teeth provided at the bottom side of the clamp, for example, or a shape of the hole of the jack post driving portion and the clamp and its variations corresponding to the shape of the slot of the base on the table board are not limited in this invention; namely, they are still included in the claims of this invention.

What is claimed is:

1. An improvement of a clip mechanism on a grinding cloth platform having a table board, in which a vertical handle is provided at a top side of the table board and an elastic foam layer is pasted on a bottom side of the table board, wherein a grinding cloth is attached at two sides of a bottom side of the foam layer and oppositely folded at the two sides of the top side on the table board and may be clamped by the clip mechanism provided on the table board, said improved clip mechanism includes comprises:

a jack post, a movable knob, and a clamp, in which the jack post is provided with a suppressing head with a larger diameter and with a shaft linking portion of a smaller diameter and a non-circular driving portion is provided at the bottom, in which the bottom of the non-circular driving portion is formed with a tapped hole;

the movable knob rotates to one side and is provided with a movable stem, in which a vertical suppressing slot with a larger diameter and a shaft hole with a smaller diameter are arranged, and at the bottom side around the shaft hole, a concave recess is formed, and the two sides of the concave recess are respectively provided with a driving cam stopping block;

for the clamp, an engaging cam surface is provided at the top side, a center recess is formed at the center of the clamp, and an engaging cam stopping block is formed at the two sides of the center recess, in which a centrally located non-circular mounting hole is provided in the center recess and several clamping teeth keeping a predefined distance with each other are provided at two sides of the underside of the clamp;

the table board, further includes a combination base formed with a non-circular attachment slot;

the jack post is further provided with the top shaft linking portion in the shaft hole of the movable knob and with the suppressing head, linking with the movable knob, in the suppressing slot of the movable knob and through the jack post provided with the non-circular driving portion inserted into the centrally located non-circular mounting hole provided in the center recess of the clamp and covering a suppressing spring at the bottom side within the clamp and with the end of the non-circular driving portion, which is inserted into the non-circular attachment slot of the combination base on the table board and attached with a locking fastener.

2. The improved clip mechanism on the grinding cloth platform of claim 1, wherein the engaging cam surface of the clamp is formed with the center recess corresponding to the driving cam surface formed at the bottom side of the movable knob enabling the clamp to move in a vertical direction on the jack post.

3. The improved clip mechanism on the grinding cloth platform of claim 1, wherein the driving cam surface on the bottom side of the movable knob equally strides across the clamp on either side of the jack post, thereby providing a precise clamp force to the clamp.

4. The improved clip mechanism on the grinding cloth platform of claim 1, wherein the centrally located non-circular mounting hole of the clamp is mounting on the non-circular driving portion of the jack post, thereby making the clamp stable and disallowing it to rotate around the non-circular driving portion so that the clamping teeth provided at bottom side of the clamp are precisely aligned with the table board, thereby securely clamping the grinding cloth.

5. The improved clip mechanism on the grinding cloth platform of claim 1, in which the driving cam surface of the movable knob provided with the driving cam stopping block engages the two sides of the anti push engaging cam surface of the clamp provided with the engaging cam stopping block, thereby allowing the movable knob to precisely move the clamp in a downward direction.

6. A clip mechanism for securing two sides of a grinding cloth to an underside of a table board of a grinding cloth platform, the table board having a solid base with a vertically mounted handle attached on a top side, a foam layer attached on the underside, and a non-circular attachment slot therethrough for attaching the clip mechanism, the clip mechanism comprising:

a jack post having a large diameter suppressing head connected to a smaller diameter linking shaft, and a non-circular driving portion protruding from the bottom of the linking shaft having a tapped hole on an opposite end for receiving a locking fastener therethrough when the jack post is mounted on the top side of the table board via the non-circular attachment slot;

a moveable knob having a handle, a vertical suppressing slot receiving the large diameter suppressing head and the smaller diameter linking shaft, a shaft hole protruding from the vertical suppressing slot rotatably receiving the non-circular driving portion, and a driving cam surface located on a lower peripheral edge of the moveable knob, the driving cam surface having a driving cam stopping block located thereon;

a clamp, having a top side with an engaging cam surface including an engaging cam stopping block, the engaging cam surface located around a peripheral edge of a center recess, the center recess having a centrally located non-circular mounting hole receiving the jack post, the bottom side of the clamp comprising a centrally located undersurface and multiple equally spaced teeth along a lower peripheral edge of the clamp; and a spring mounted around the jack post and located between the centrally located undersurface of the clamp and the top side of the table board for biasing the clamp in a direction away from the top side of the table board;

wherein, rotational movement of the moveable knob via the knob handle causes the driving cam surface of the moveable knob located within the center recess of the clamp to move out of the center recess of the clamp and onto the engaging cam surface of the clamp, thereby moving the clamp along the non-circular shaft in a direction opposite the biasing of the spring, the rotational movement of the moveable knob stopping when the driving cam stopping block engages the engaging cam stopping block.

* * * * *